US005860377A

United States Patent [19]

Akahane et al.

[11] Patent Number: 5,860,377

[45] Date of Patent: Jan. 19, 1999

[54] SEWING MACHINE WITH A SPEED CORRECTING UNIT AND AN INDEPENDENTLY DRIVEN MAIN SHAFT AND LOOP TAKER

[75] Inventors: Koichi Akahane, Nagoya; Takashi Kondo, Obu; Koichi Harada, Komaki; Motonari Nakano, Ichinomiya; Yoshihisa Nozaki, Hoi-gun, all of Japan

[73] Assignee: Brother Kogyo Kabushiki Kaisha, Nagoya, Japan

[21] Appl. No.: 972,737

[22] Filed: Nov. 18, 1997

[30] Foreign Application Priority Data

Nov. 19, 1996 [JP] Japan ..... 8-324556

[51] Int. Cl.[6] ..... D05B 19/12; D05B 69/18

[52] U.S. Cl. ..... 112/470.01; 112/220; 112/275

[58] Field of Search ..... 112/470.01, 220, 112/221, 275, 277, 181

[56] References Cited

U.S. PATENT DOCUMENTS 5,660,129 8/1997 Murata ..... 112/470.01

5,778,810 7/1998 Akahane et al. ..... 112/470.01

FOREIGN PATENT DOCUMENTS

SHO-60-21750 5/1985 Japan .

SHO-61-15816 5/1986 Japan .

HEI-3-234291 10/1991 Japan .

HEI-3-234293 10/1991 Japan .

*Primary Examiner*—Peter Nerbun

*Attorney, Agent, or Firm*—Oliff & Berridge PLC

[57] ABSTRACT

A sewing machine, with independently driven main shaft and loop taker, stores a table containing preset speed correction values for negating rotational speed variations in the loop taker drive shaft caused by torque variations on the same; sets speed correction amounts based on speed correction values read from the speed correction value table; and outputs correction drive signals indicative of those speed correction values to the loop taker drive motor.

20 Claims, 9 Drawing Sheets

8: UPPER SHAFT (MAIN SHAFT)
12: LOWER SHAFT (LOOP TAKER DRIVE SHAFT)

40

[SPEED CORRECTION VALUE TABLE]

| ANGLE OF LOWER-SHAFT [° ] | SPEED CORRECTION VALUE BASED ON ROTATIONAL SPEED (rpm) (%) | | | | | |
|---|---|---|---|---|---|---|
| | 100 | 200 | 300 | | | 2500 |
| 0 | C[1][0] | C[2][0] | C[3][0] | | | C[25][0] |
| 1 | C[1][1] | C[2][1] | C[3][1] | | | C[25][1] |
| 2 | C[1][2] | · | · | | | · |
| 3 | · | · | · | | | · |
| · | · | · | · | | | · |
| · | · | · | · | | | · |
| · | · | · | · | | | · |
| · | · | · | · | | | · |
| · | · | · | · | | | · |
| · | · | · | · | | | · |
| · | · | · | · | | | · |
| · | · | · | · | | | · |
| 359 | C[1][359] | C[2][359] | C[3][359] | | | C[25][359] |

50

PARAMETER TABLE

| θs | A | T |
|---|---|---|
| θs1 | A1 | T1 |
| θs2 | A2 | T2 |

SEWING MACHINE WITH A SPEED CORRECTING UNIT AND AN INDEPENDENTLY DRIVEN MAIN SHAFT AND LOOP TAKER

BACKGROUND OF THE INVENTION

1. Field of the Invention

The present invention relates to a sewing machine for synchronously controlling a main shaft and a loop taker with separate motors.

2. Description of the Related Art

A conventional ordinary sewing machine mainly includes a bed portion, a column portion, an arm portion, and a head portion. In the head portion, a needle bar, a sewing needle, and a needle thread take up lever are vertically driven by a driving force of a main shaft. In the bed portion, a loop taker is driven by a lower shaft to cooperate with the sewing needle to form thread loops with a sewing thread. According to a sewing machine of an ordinary type, the lower shaft is driven also by the main shaft because the loop taker has to be moved synchronously with the sewing needle.

There has been proposed sewing machines of another type that employs a special loop taker drive motor for driving the loop taker independently from the main shaft. In this type of sewing machines, the loop taker can be moved synchronously with the main shaft. Minute-by-minute rotational states of the loop taker can be precisely controlled according to a sewing condition.

For example, Japanese Examined Patent Application Publication (Kokoku) No. SHO-60-21750 proposes a sewing machine provided with a needle drive motor for driving a sewing needle and a loop taker drive motor for driving a loop taker. The sewing machine drives the two motors synchronously with each other so that the sewing needle and the loop taker operate synchronously to each other to sew a perfect seam.

Japanese Laid-Open Patent Publication (Kokai) No. SHO-61-15816 proposes another sewing machine that controls synchronization between the needle drive motor and the loop taker drive motor, thereby preventing skipped stitches and improving the tightness of the stitches.

Japanese Laid-Open Patent Application Publications (Kokai) Nos. HEI-3-234291 and HEI-3-234293 provide other sewing machines that maintain interlocking operations between the sewing needle and the loop taker. In each of these sewing machines, a sewing motor is provided to drive the sewing needle via the main shaft. A loop taker driving motor is provided separately and independently from the sewing motor. The loop taker driving motor is for driving the loop taker. A rotary encoder is provided to the main shaft for detecting the rotational amount of the main shaft. When the main shaft is rotated manually, the loop taker drive motor is automatically rotated exactly the amount the main shaft has been rotated. Accordingly, the interlocking relationship between the loop taker and the sewing needle is maintained.

The above-described sewing machines with independently driven main shaft and loop taker is designed so as to detect the origin of the main shaft, the rotational angle of the sewing motor, the origin of the loop taker, and the rotational angle of the loop taker drive motor. Detection signals indicative of the detected results are used to control the sewing motor and the loop taker drive motor to rotate them synchronously with each other.

SUMMARY OF THE INVENTION

When deviations occur in the synchronous control, however, the needle and the loop taker may possibly interfere with each other. This causes damages to the needle and/or the loop taker and degrades the product quality. Further, if the sewing conditions such as the thickness of a workpiece to be sewn and the type of stitch pattern are changed, loads applied to the sewing motor and the loop taker drive motor will change. This will change torques applied to the main shaft and the loop taker drive shaft. The torque on the loop taker drive shaft will change also due to behavior of the loop taker. As a result, the rotational speeds of the main shaft and the loop taker drive shaft will change. Deviations will occur in the synchronous control.

In order to restrain those torque variations, the loads on the loop taker and the loads on a drive force transfer system are reduced in the conventional sewing machines. Still, the conventional sewing machines suffer from torque variations. Particularly when the loop taker is an oscillating shuttle, large changes occur in torque applied on the loop taker drive system. These changes in torque cause large rotational speed variations in the loop taker drive shaft as shown in solid line in FIG. 1. Because the rotational speed of the main shaft is indicated by a two-dots-and-one-chain line in FIG. 1, synchronization discrepancies occur between the loop taker and the sewing needle. This problem occurs because the loop taker drive system passes through mechanical points of discontinuity when the loop taker (oscillating shuttle) reverses its rotational direction during its reciprocating rotational movement and when the loop taker takes a needle thread which extends from the sewing needle.

An object of the present invention is therefore to solve the above-described problem and to provide an improved sewing machine which can eliminate the synchronization discrepancies.

In order to attain the above and other objects, the present invention provides a sewing machine, comprising: a sewing motor for driving a needle bar and a sewing needle via a main shaft; a loop taker drive motor for driving a loop taker via a loop taker drive shaft independently from the main shaft thereby causing the loop taker to operate in cooperation with the sewing needle to take a sewing thread loop; a first detection unit for detecting both an origin position of the main shaft and a rotational angle of the sewing motor and for outputting detection signals indicative of the detected results; a second detection unit for detecting both an origin position of the loop taker and a rotational angle of the loop taker drive motor and for outputting detection signals indicative of the detected results; a synchronization control unit for controlling at least one of the sewing motor and the loop taker drive motor based on the detection signals supplied from the first and second detection units, thereby causing the loop taker to rotate synchronously to the main shaft; and a speed correcting unit for correcting a rotational speed of the loop taker drive motor to eliminate rotational speed variations generated in the loop taker drive shaft.

The speed correcting unit may correct the rotational speed of the loop taker drive motor based on a detection signal indicative of the rotational angle of the loop taker drive motor which is supplied from the second detection unit.

The speed correcting unit may include: a correction amount obtaining unit for obtaining a correction amount based on the detection signal indicative of the rotational angle of the loop taker drive motor which is supplied from the second detection unit, the correction amount being capable of correcting the rotational speed of the loop taker drive motor to eliminate the rotational speed variations generated in the loop taker drive shaft; and a correction drive signal producing unit for producing a correction drive signal based on the obtained correction amount and for correcting the rotational speed of the loop taker drive motor based on the correction drive signal.

DETAILED DESCRIPTION OF THE PREFERRED EMBODIMENT

A sewing machine with independently driven main shaft and loop taker according to a preferred embodiment of the present invention will be described below while referring to the accompanying drawings.

Figure 1:
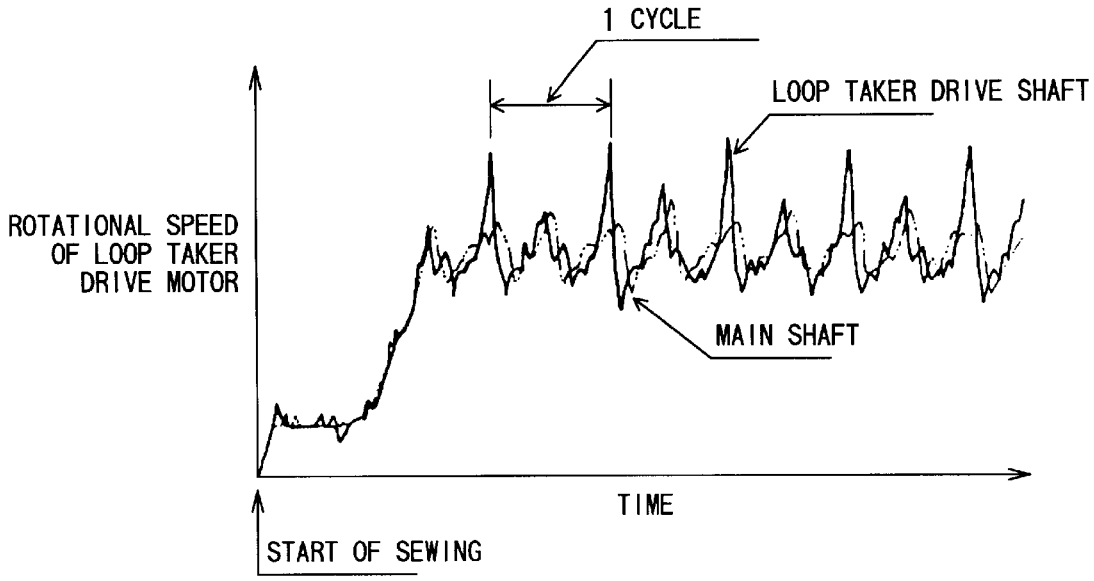
FIG. 1 is a graph showing the rotational speeds, in relation to time, of a main shaft and a loop taker drive shaft in a conventional sewing machine.
Figure 2:
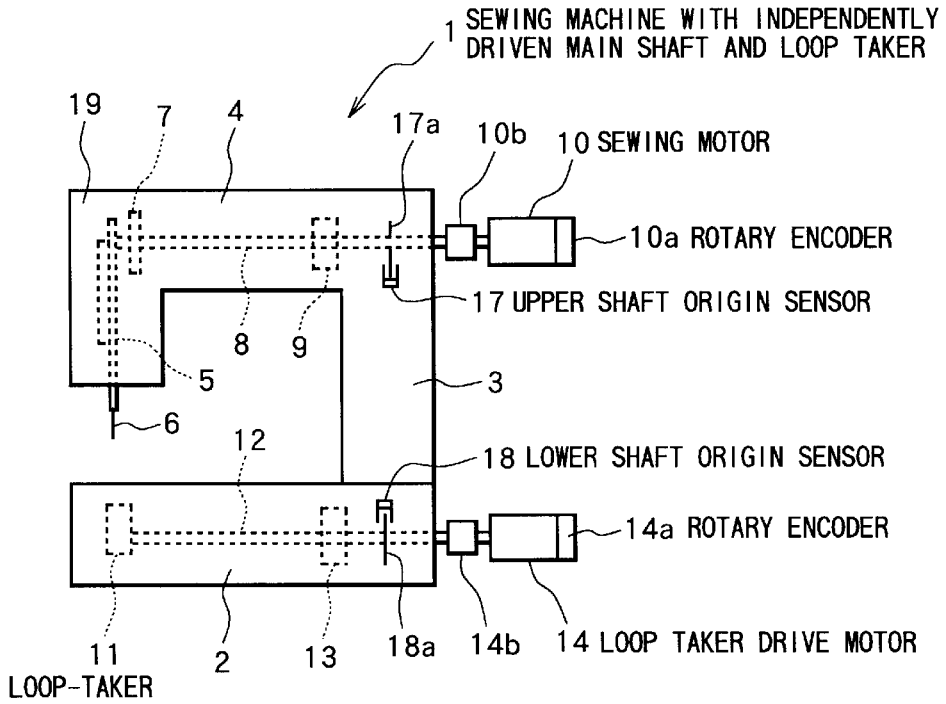
FIG. 2 is an approximate front view of a sewing machine with independently driven main shaft and loop taker according to an embodiment of the present invention.

As shown in FIG. 2, the body of a sewing machine 1 of the present embodiment includes a bed portion 2, a column portion 3, and an arm portion 4. A head portion 19 is provided on the end of the arm portion 4. A needle bar 5 is supported by a needle bar connecting stud in the head portion 19 so as to move freely upward and downward. A sewing needle 6 is mounted in the lower end of the needle bar 5. An upper shaft 8 (main shaft) is provided inside the arm portion 4. One end of the upper shaft 8 is coupled with the needle bar 5 via a needle bar crank 7. The upper shaft 8 is freely rotatably supported by a bearing 9. Although not shown in the drawings, a needle thread take up lever is coupled with the upper shaft 8 via a thread take up crank. A sewing motor 10 is provided on and fixed to the outer side of the sewing machine body. An output shaft of the sewing motor 10 is coupled with the upper shaft 8 via a coupling 10*b*. The upper shaft 8 is rotatedly driven by the sewing motor 10. This sewing motor 10 is a servo motor provided with a rotary encoder 10*a* and is controlled by a control unit 20 described below.

A loop taker 11, such as an oscillating shuttle, is provided within a section of the bed portion 2 corresponding to the sewing needle 6. A lower shaft 12 (loop taker drive shaft) is provided in the bed portion 2 to drive the loop taker 11. A bearing 13 freely rotatably supports this lower shaft 12. A loop taker drive motor 14 is provided either on the outer side of the sewing machine body or within the bed portion 2. An output shaft of the loop taker drive motor 14 is coupled with the lower shaft 12 via a coupling 14*b*. The lower shaft 12 is rotatably driven by the loop taker drive motor 14. This loop taker drive motor 14 is a servo motor provided with a rotary encoder 14*a* and is controlled also by the control unit 20.

In order to detect a predetermined origin position of the upper shaft 8, an approximately semi-circular shaped detection disk 17*a* is fixed on the upper shaft 8, and an upper shaft origin sensor 17, which is a photointerrupter, is located facing the detection disk 17*a*. That is, a light source element and a light detector element constituting the photointerruptor are positioned on both sides of the detection disk 17*a*. It is noted that according to the present embodiment, the upper shaft 8 is at the position of the origin when the rotational angle of the upper shaft 8 becomes 0°, at which time the sewing needle 6 is in its uppermost position. When the upper shaft 8 is rotated to its position of origin, the upper shaft origin sensor 17 switches ON and remains ON until just before the needle reaches its lowermost position. When the needle reaches its lowest position, the upper shaft origin sensor 17 switches OFF and remains OFF until just before the needle reaches its uppermost position. Detection signals from the upper shaft origin sensor 17 are supplied to the control unit 20.

In order to detect a predetermined origin position of the lower shaft 12, a detection disk 18*a* having a slit on its circumference is fixed on the lower shaft 12, and a lower shaft origin sensor 18, which is a photointerrupter, is located facing the detection disk 18*a*. That is, a light source element and a light detection element constituting the photointerruptor are positioned on both sides of the detection disk 18*a*. It is noted that according to the present embodiment, the lower shaft 12 is at the position of the origin when the rotational angle of the lower shaft 12 becomes 0°, at that time the upper shaft 8 is at its own origin position if the rotational positional relationship between the upper shaft 8 and the lower shaft 12 is set properly. When the lower shaft 12 is rotated to its position of origin, the lower shaft origin sensor 18 switches ON. When the lower shaft 12 is in any other position, the lower shaft origin sensor 18 is OFF. Detection signals from the lower shaft origin sensor 18 are supplied also to the control unit 20.

It is noted that when the loop taker 11 rotates synchronously with the main shaft 8, the loop taker 11 reaches its origin position when the main shaft 8 is at its own origin position. A looper seizing beak of the loop taker 11 encounters the sewing needle 5 at a predetermined angle of encounter when the upper shaft 8 and the lower shaft 12 are positioned both at the same phase angular position (encounter angle) of 204.5°, for example. The loop taker 11 works in cooperation with the sewing needle 5 to form a thread loop with a needle thread (sewing thread) and performs sewing operation using the needle thread and a bobbin thread. Thus, when the phase angle of the loop taker 11 is equal to the angle of encounter when the phase angle of the main shaft 8 is equal to the angle of encounter, synchronization between the main shaft 8 and the loop taker 11 is attained.

Next, the control system of the sewing machine 1 will be described.

Figure 3:
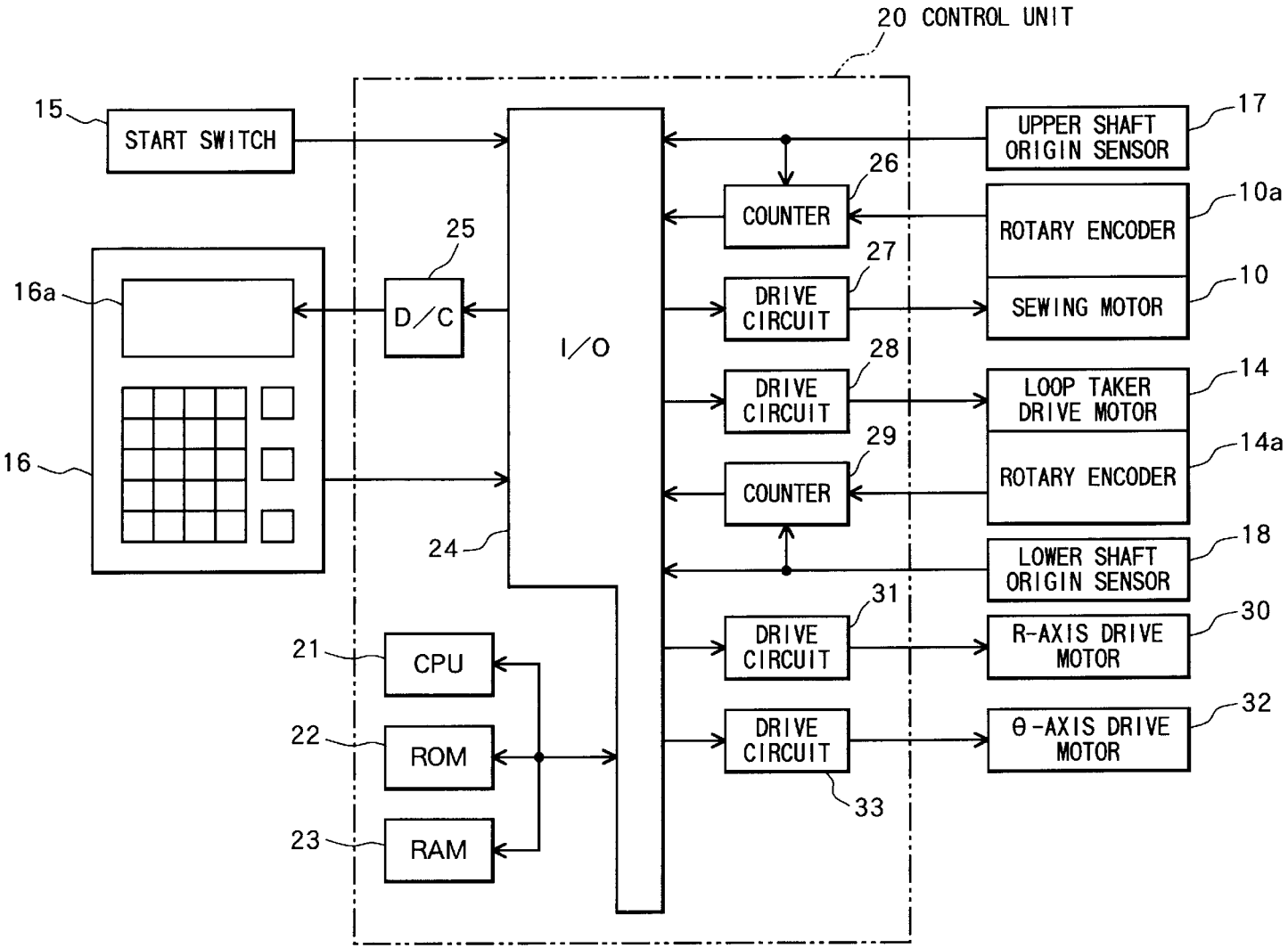
FIG. 3 is a block diagram showing a control system of the sewing machine.

As shown In FIG. 3, the control unit 20, provided in the sewing machine 1, includes a CPU 21, a ROM 22, a RAM 23, an input/output interface 24, a counter 26 for counting detection signals from the rotary encoder 10*a*, a drive circuit 27 for driving the sewing motor 10, a drive circuit 28 for driving the loop taker drive motor 14, a counter 29 for counting detection signals from the rotary encoder 14*a*, drive circuits 31 and 33, and a display controller 25. The counter 26 is reset to zero when detection signals from the upper shaft origin sensor 17 switch from OFF to ON. The counter 29 is reset to zero when the detection signal from the lower shaft origin sensor 18 becomes ON. Further, it is desirable that the rotary encoders 10*a* and 14*a* have a resolution of at least about 0.1° for the angle of the upper shaft 8 and the lower shaft 12, respectively.

A start switch 15 is provided on the sewing machine 1 and is connected to the input/output interface 24. A control panel 16 containing a variety of switches is provided on the sewing machine 1. Signals from the switches are supplied to the input/output interface 24. A liquid crystal display (LCD) 16*a* on the control panel 16 is controlled by the display controller 25. An R-axis drive motor 30 and the θ-axis drive motor 32 are provided to independently feed a workpiece to be sewn in the R direction and the θ direction, respectively, in a predetermined R-θ coordinate system. The R-axis drive motor 30 and a θ-axis drive motor 32 are controlled by the driving circuits 31 and 33. The RAM 23 is formed with a memory work area necessary for performing various controls.

Although not shown in the drawing, a pedal is connected to the sewing machine 1. A reference speed Ss is determined in accordance with the amount by which the pedal is pressed by a user. The reference speed Ss will frequently change according to the pedal pressed amount. The reference speed Ss can be determined by the CPU 21 based on data of a sewing pattern to be sewn which is stored in the ROM 22. Also in this case, the reference speed Ss will frequently change according to the presently-counted stitch number, a pitch of the present stitch, and the like. Data of the reference speed Ss is supplied via the interface 24 to the RAM 23.

Figures 4, 5:
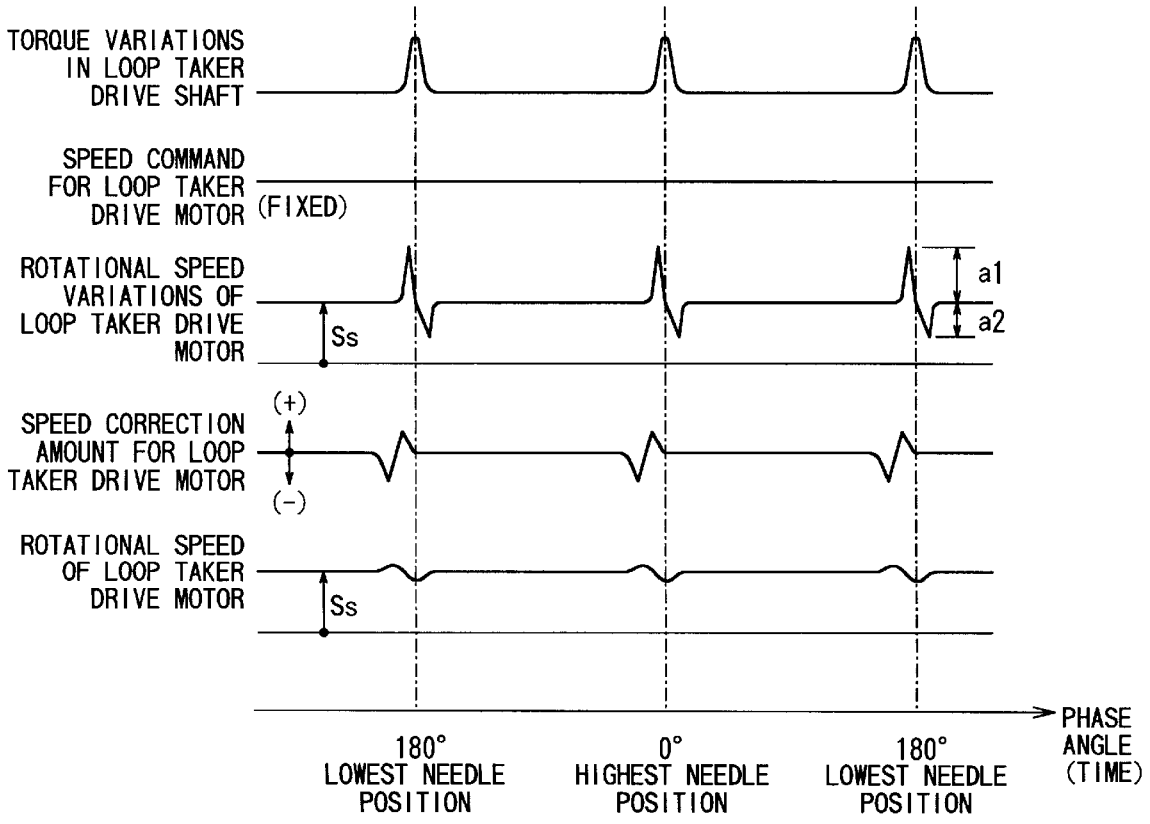
FIG. 4 is a table listing speed correction values.
FIG. 5 is a graph showing torque variations, rotational speed variations, and speed correction amounts of the lower shaft.

The ROM 22 stores therein control programs and a speed correction value table 40. The table 40 lists speed correction values as shown in FIG. 4. The control programs include: a motor drive control program for controlling the rotational speeds of the sewing motor 10 and the loop taker drive motor 14; and a sewing control program for controlling synchronization between the sewing motor 10 and the loop taker drive motor 14 and for correcting the rotational speed of the lower shaft 12.

The motor drive control is designed to perform feedback operation with the use of detection signals issued from the counters 26 and 29 in controlling the rotational speeds of the sewing motor 10 and the loop taker drive motor 14 at the reference speed Ss.

Figure 6:
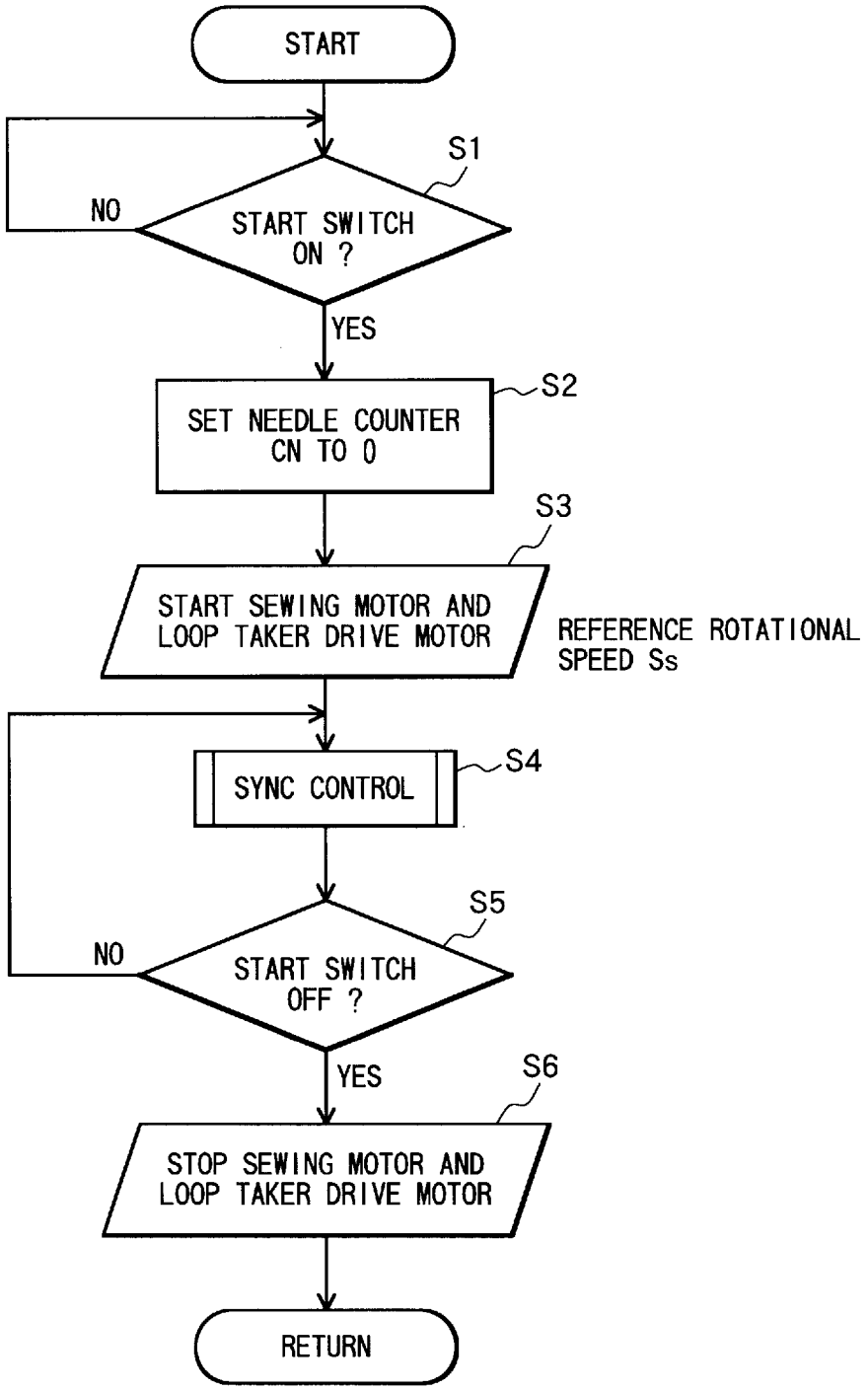
FIG. 6 is a flowchart showing a sewing control routine.

The sewing control program is shown in FIG. 6. It is noted that the sewing control program includes a synchronization control program of FIG. 7. The synchronization control program includes a lower shaft rotational speed correction program shown in FIG. 8.

As described above, the ROM 22 previously stores therein the speed correction value table 40 shown in FIG. 4. The speed correction value table 40 lists a plurality of speed correction values C[i][j] for one rotation (cycle) of the sewing machine 1 and for various reference speeds Ss capable of being set for the sewing motor 10. More specifically, the speed correction value table lists a plurality of speed correction values C[i][j] for the lower shaft rotational angle from 0 to 359 degrees and for the reference speed Ss from 100 to 2,500 rpm. Each speed correction value C[i][j] is previously calculated as a speed correction amount which is issued to the motor drive control to correct the rotational speed of the loop taker drive motor 14 when the rotational angle of the lower shaft 12 is equal to "j" degrees and when the reference speed Ss is equal to "i×100" rpm.

In other words, the table 40 stores therein a plurality of speed correction values C[i][j] where $1 \leqq i(=Ss/100) \leqq 25$ and where $0 \leqq j \leqq 359$. Each speed correction value C[i][j] is previously calculated as a correction amount to be issued to the motor drive control when the lower shaft 12 is at a "j-degree" angular position if the speed Ss is equal to "i×100" rpm in order to neutralize rotational speed variations occurring in the lower shaft 12 due to variations in torque applied to the loop taker 11.

It is noted that due to torque variations in the loop taker 11, approximately pulse-shaped torque variations occur in the lower shaft 12 near the phase angles 0° and 180° as shown in FIG. 5. Because the loop taker drive motor 14 is a servo motor, when the torque variations occur in the lower shaft 12, rotational speed variations occur in the loop taker drive motor 14 as in the form of a differential wave of the torque variations. The sizes of the amplitudes "a1" and "a2" of the differential waveform vary according to the reference speed $S_s$, the gain of the servo system, and the like. In view of this, according to the present embodiment, the speed correction values C[i][j] have been previously calculated to neutralize as much as possible the differential wave rotational speed variations. Using these speed correction values C[i][j], a speed correction amount is repeatedly determined for the loop taker drive motor 14 while the sewing motor 1 performs sewing operation. Based on the thus determined speed correction amount, the rotational speed of the loop taker drive motor 14 is corrected through the motor drive control, thereby neutralizing the rotational speed variations.

Next, the sewing control process will be described with reference to the flowcharts in FIGS. 6 through 8.

As shown in FIG. 6, the control process begins when a power source (not shown) in the sewing machine 1 is turned on. The control process remains in a standby state until the start switch 15 is determined to be ON. When the operator switches the start switch 15 ON ("yes" in S1) a needle counter CN (not shown) is initialized to zero in S2. The needle counter CN is used for counting the number of stitches while a stitch pattern is being sewn by the sewing needle 6.

Next, the sewing motor 10 and the loop taker drive motor 14 are started to be driven in S3. The sewing motor 10 and the loop taker drive motor 14 are controlled by the motor drive control to operate at the reference speed Ss.

More specifically, according to the motor drive control program stored in the ROM 22, the CPU 21 performs control operation on the counters 26 and 29, performs calculation, and issues speed commands to the drive circuits 27 and 28. That is, the CPU 21 controls the counter 26 to count feedback pulses supplied from the rotary encoder 10*a*. The CPU 21 calculates changes in the counted number of the feedback pulses in a predetermined time unit. For example, the CPU 21 calculates the number of pulses that have occurred during every one millisecond [msec]. Or, the CPU 21 may calculate changes in time required from issuance of one pulse to issuance of the next pulse. For example, the CPU 21 counts the time required for every ten pulses. The CPU 21 then determines the present rotational speed Su of the sewing motor 10. The CPU 21 then calculates a difference between the calculated present speed Su and the reference speed Ss, with which the motor 10 is desired to rotate. Then, the CPU 21 supplies the drive circuit 27 with a speed command dSu (=Ss−Su) which is indicative of a speed changing amount, with which the speed of the sewing motor 10 has to be changed.

Simultaneously, the CPU 21 controls the counter 29 to count feedback pulses supplied from the rotary encoder 14*a*. In the same manner as described above, the CPU 21 calculates changes in the counted number of the feedback pulses, and determines the present rotational speed Sd of the loop taker drive motor 14. The CPU 21 then calculates a difference between the present speed Sd and the reference speed Ss. Then, the CPU 21 supplies the drive circuit 28 with a speed command dSd (=Ss−Sd) which is indicative of a speed changing amount, with which the speed of the motor 14 has to be changed.

The above-described operation is repeatedly performed so that the difference between the actual speed of each of the motors 10 and 14 and the reference speed Ss will gradually decrease.

Next, a synchronization control subroutine is executed in S4 as described later. Then, in S5, it is determined whether the start switch 15 is turned OFF. As long as the start switch 15 is ON, the steps S4 and S5 are repeated and sewing operations are executed. When sewing of the user's desired stitch pattern has been completed, for example, the user switches the start switch 15 to OFF ("yes" in S5). As a result, the sewing motor 10 and the loop taker drive motor 14 are stopped in S6, and the process is repeated from S1. This process is ended when the power source for the sewing machine 1 is turned off.

The synchronization control subroutine of S4 will be described below with reference to FIG. 7.

This synchronization control subroutine is attained in order to control the movement of the upper shaft 8 in accordance with the movement of the lower shaft 12.

During the synchronization control subroutine, the current value of the upper shaft counter 26 is first read in S10. Based on the read value, the current rotational angle Up of the upper shaft 8 is calculated in S11. The calculated value Up is stored in the RAM 23. For example, the rotational angle Up is calculated as 0° when the current position of the upper shaft 8 brings the needle 6 into the uppermost position. The rotational angle Up is calculated as 180° when the current position of the upper shaft 8 brings the needle into the lowermost position.

Next, the current value of the lower shaft counter 29 is read in S12. Based on the read value, the current rotational angle Dp of the lower shaft 12 is calculated and stored in the RAM 23 in S13. Then, in S14, a phase shift amount Z between the rotational angles Dp and Up of the lower and upper shafts 12 and 8 is calculated using the equation Z=(Up−Dp). The calculated phase shift amount Z is stored in the RAM 23. Then, in S15, it is judged whether or not the shift amount Z is equal to or greater than zero. When Z is greater than or equal to zero ("yes" in S15), indicating that the upper shaft 8 has advanced further than the lower shaft 12, then the rotational speed of the sewing motor 10 is reduced by an amount of k×Z in S16, where k is a predetermined constant and k<0.

More specifically, command signals or command data are output to instruct the motor drive control to decrease the rotational speed of the sewing motor 10 by the amount of k×Z. It is noted that when Z=0, then k=0, and the operation to decrease the sewing motor speed is not performed essentially.

When receiving the command signals indicative of the decrease amount k×Z, the CPU 21 produces a synchronization-effected speed command cSu as described below according to the motor drive control program. That is, the CPU 21 changes the speed command dSu (=Ss−Su) into a synchronization-effected speed command cSu (=dSu−kZ) where kZ<0. This command cSu is indicative of a speed changing amount, with which the speed of the motor 10 has to be changed both in order to attain the reference speed Ss and in order to attain synchronization with the motor 14. The CPU 21 then issues the synchronization-effected speed command cSu (=dSu+kZ) to the drive circuit 27.

On the other hand, when Z is less than zero ("no" in S15), indicating that the lower shaft 12 has advanced further than the upper shaft 8, then the rotational speed of the sewing motor 10 is increased by the amount of k×Z in S17. More specifically, command signals or command data are output to instruct the motor drive control to increase the sewing motor speed by the amount of k×z. Also in this case, the CPU 21 issues a synchronization-effected speed command cSu (=dSu+kZ) (where kZ>0) in the same manner as described above according to the to motor drive control program.

Hence, the above-described synchronization control process can synchronize the upper shaft 8 and the lower shaft 12 so that the rotational angles (phase angles) of both shafts are in agreement.

Following either S16 or S17, a rotational speed correction subroutine is executed for the lower shaft in S18 as described later. Then, it is determined in S19 whether the upper shaft origin sensor 17 has switched from OFF to ON, indicating that the needle has reached the uppermost position. If the upper shaft origin sensor 17 has switched from OFF to ON ("yes" in S19), then the needle counter CN is incremented by one in S20, and the process returns to S5 in FIG. 6. If the upper shaft origin sensor 17 has not yet switched from OFF to ON ("no" in S19), then the process returns to S5 in FIG. 6 without incrementing the counter CN.

Next, the lower shaft rotational speed correction subroutine of S18 will be described with reference to FIG. 8.

This subroutine is provided for correcting the speed command dSd to be issued to the drive circuit 28, in accordance with the present rotational position of the lower shaft 12 and the reference speed Ss, in order to eliminate speed variations of the lower shaft 12.

First, data of the reference rotational speed $S_s$ is read from the RAM 23 in S30. The speed correction value table 40 of FIG. 4 is searched referring to the rotational speed data Ss and the current rotational angle Dp of the lower shaft 12, which is calculated in S13. Then, a speed correction value C[i][j] where $i=S_s/100$ and j=Dp is selected as a speed correction value A for correcting the current speed variation.

It is noted that interpolation technique is used when Ss/100 is not equal to any values i listed in the table and/or when Dp is not equal to any values j listed in the table. If the value Ss/100 is higher than i and lower than i+1 where $1 \leqq i \leqq 24$ and if the value Dp is higher than j and lower than j +1 where $0 \leqq j \leqq 358$, the speed correction value A is calculated through selecting four correction values C[i][j], C[i+1][j], C[i][j+1], and C[i+1][j+1] from the table and then interpolating the selected values.

Next, in S31, a rotational speed correction amount ΔS for the lower shaft 12 is calculated using the equation $\Delta S=S_s \times A/100$. Correction drive signals, indicative of this rotational speed correction amount ΔS, are output to the motor drive control in S32. In response to the correction drive signals, according to the motor drive control program, the CPU 21 supplies the loop taker drive motor 14 with drive signals whose amounts are corrected by the correction amount ΔS. That is, the CPU 21 changes the speed command dSd (=Ss−Sd) into a variation-corrected speed command cSd (=dSd+ΔS). This command cSd is indicative of a speed changing amount, with which the speed of the motor 14 has to be changed both in order to attain the reference speed Ss and in order to eliminate the speed variations. The CPU 21 then issues the variation-corrected speed command cSd (=dSd+ΔS) to the drive circuit 28. The process then returns to S19.

By performing the above-described synchronization control, rotations of the upper shaft 8 and the lower shaft 12 are synchronized. The sewing machine 1 of the present embodiment can reliably perform sewing of a desired quality. Further, the rotational speed correction amount ΔS for correcting the rotational speed of the loop taker drive motor 14 can be determined by merely applying the main motor speed Ss and the current rotational angle Dp of the lower shaft 12 to the predetermined rotational speed correction value table 40 each time the synchronization control process is executed. As a result, rotational variations in the lower shaft 12, which are caused by torque variations of the loop taker 11, can be eliminated or nearly eliminated, and synchronization precision between the upper shaft 8 and the lower shaft 12 can be increased, thereby resulting in a reliable increase in sewing quality.

As described above, according to the present embodiment, the sewing machine 1 is provided with the independently-driven main shaft 8 and loop taker 11. The sewing machine 1 stores therein the table 40 containing previously-set speed correction values for negating rotational speed variations in the loop taker drive shaft which will be caused by torque variations on the same. The sewing machine 1 easily determines speed correction amounts based on speed correction values read from the speed correction value table 40, and outputs correction drive signals indicative of the determined speed correction amounts to the loop taker drive motor. Thus, the rotational speed variations of the loop taker drive shaft is controlled via a software operation.

Next, a modification of the sewing control process of the above-described embodiment will be described with reference to FIGS. 9 through 12.

Figures 10, 11:
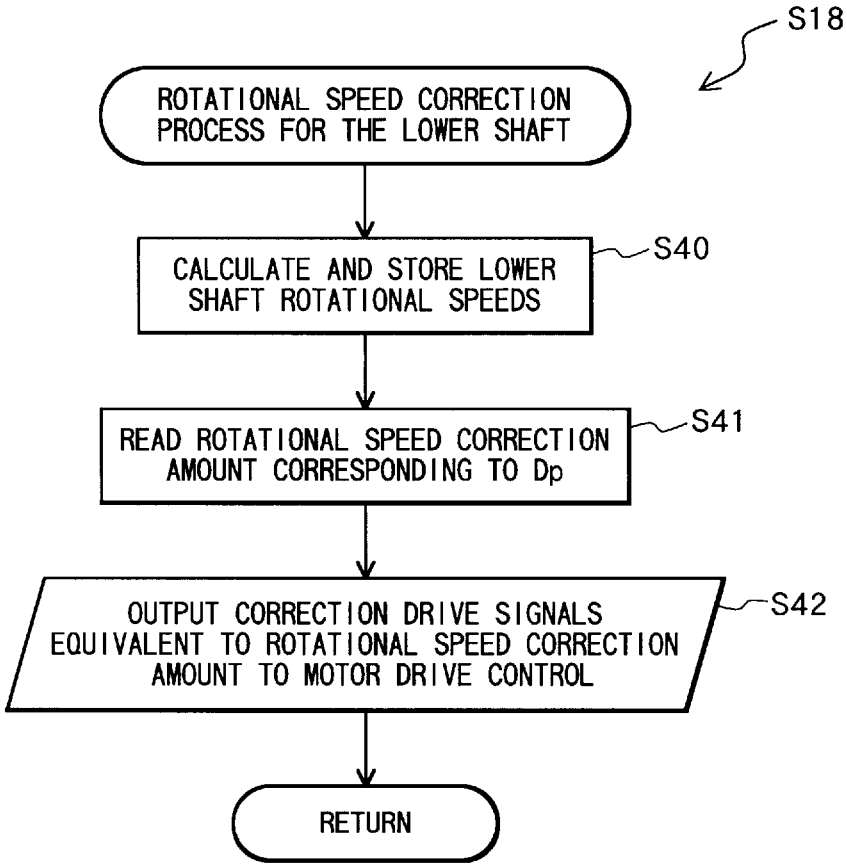
FIG. 10 is a parameter table employed in the modification.
FIG. 11 is a flowchart showing a lower shaft rotational speed correction process subroutine according to the modification.
Figure 12:
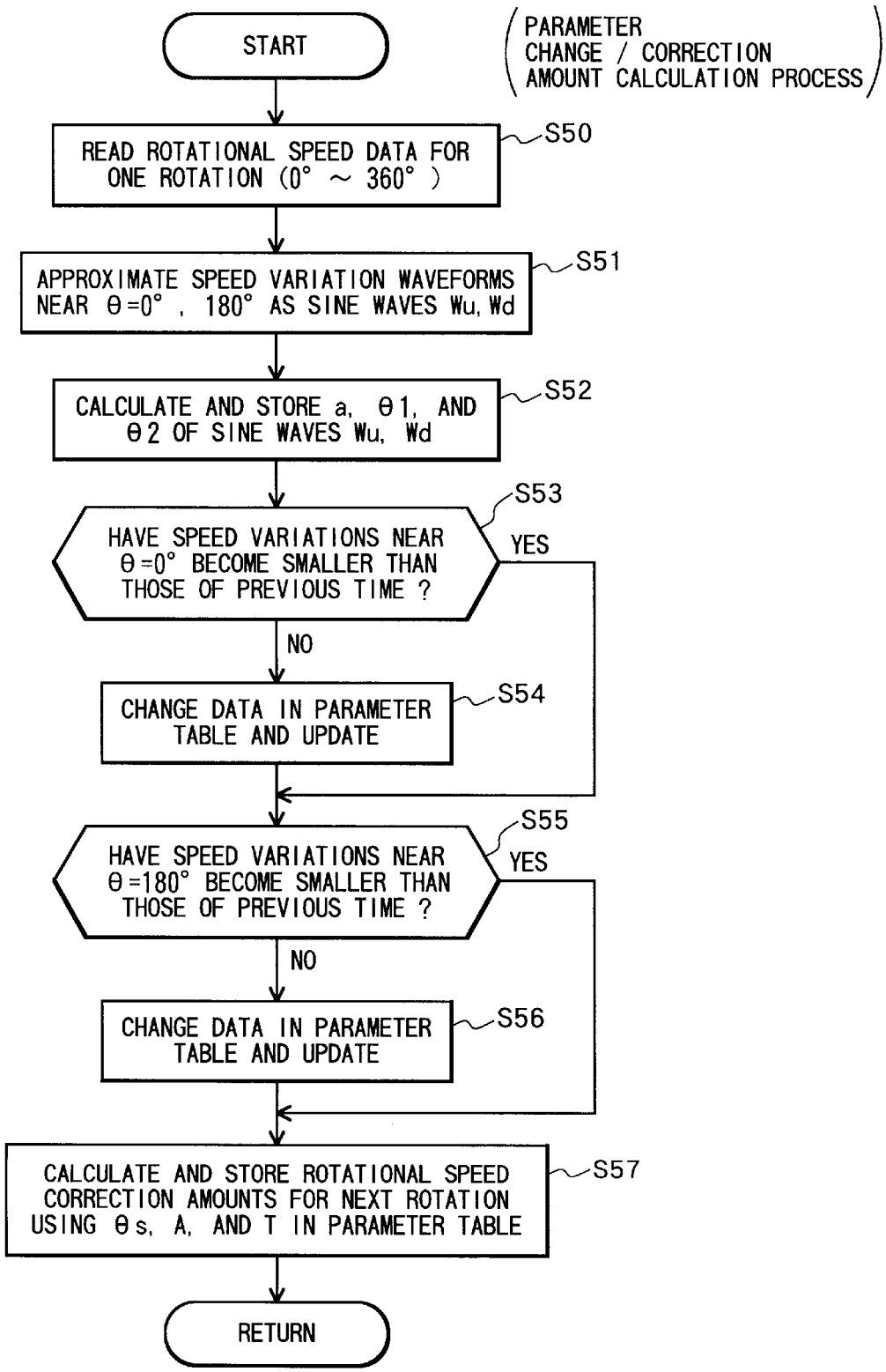
FIG. 12 is a flowchart showing a parameter change/correction amount calculation process according to the modification.

This modification is the same as that of the above-described embodiment except that a parameter table 50 shown in FIG. 10 is stored in the ROM 22 in place of the table 40, that the lower shaft rotational speed correction routine of S18 is executed as shown in FIG. 11, and an interrupt routine is executed as shown in FIG. 12 every time the upper shaft 8 reaches the position of origin (uppermost needle position). That is, the interrupt routine of FIG. 12 is repeatedly attained while the processes of FIGS. 6 and 7 are performed with the subroutine of S18 being performed as shown in FIG. 11.

Figure 9:
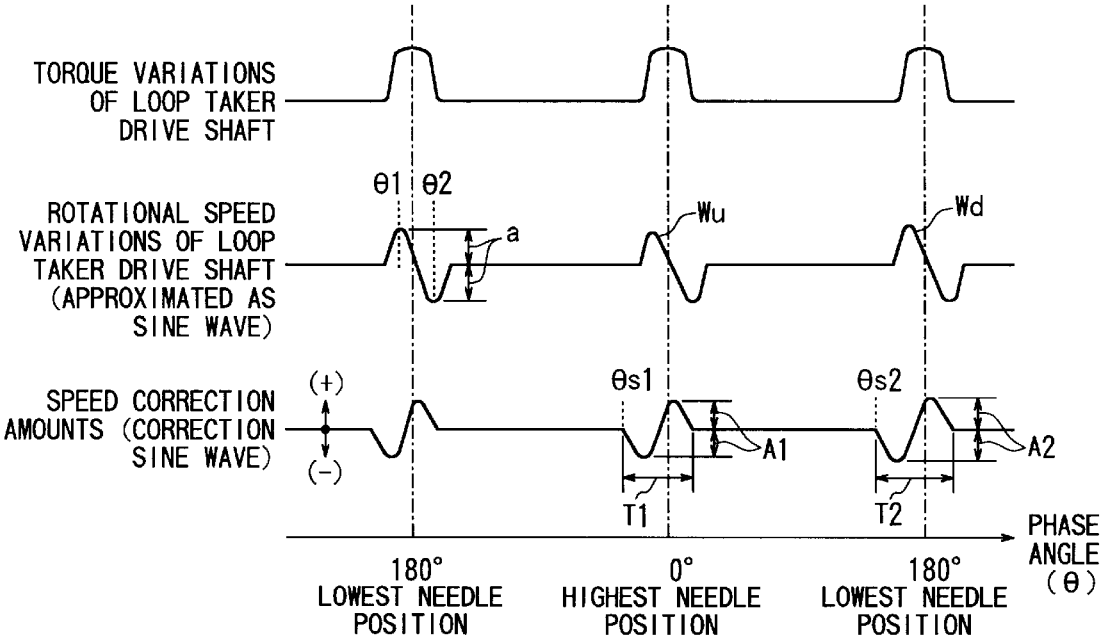
FIG. 9 is a graph showing torque variations, rotational speed variations, and speed correction amounts of a lower shaft according to a modification the embodiment.

According to this modification, it is estimated that the rotational speed variations in the lower shaft 12, which are caused by torque variations of the loop taker 11 when the upper shaft 8 and the lower shaft 12 are around the 0-degree and 180-degree angular positions, are in the form of approximate sine waves as shown in FIG. 9. This estimation is preferable because the sine wave can be approximated by various waveforms through Fourier expansion operation. Based on this estimation, according to the present modification, the ROM 22 is previously stored with data indicative of a pair of correction sine waves which are estimated as capable of neutralizing the sine wave-shaped rotational speed variations. More specifically, the ROM 22 is previously stored with the parameter table 50 shown in FIG. 10. The parameter table 50 stores: data of initial values for an amplitude A1, a period T1, and a phase angle θs1 defining a correction sine wave capable of correcting rotational speed variation near the lower shaft rotational angle of 0°; and data of initial values for an amplitude A2, a period T2, and a phase angle θs2 defining another correction sine wave capable of correcting rotational speed variation near the lower shaft rotational angle of 180°. It is noted that each of the phase angles θs1 and θs2 indicates a starting position (phase angle) of the corresponding correction sine wave.

Figure 7:
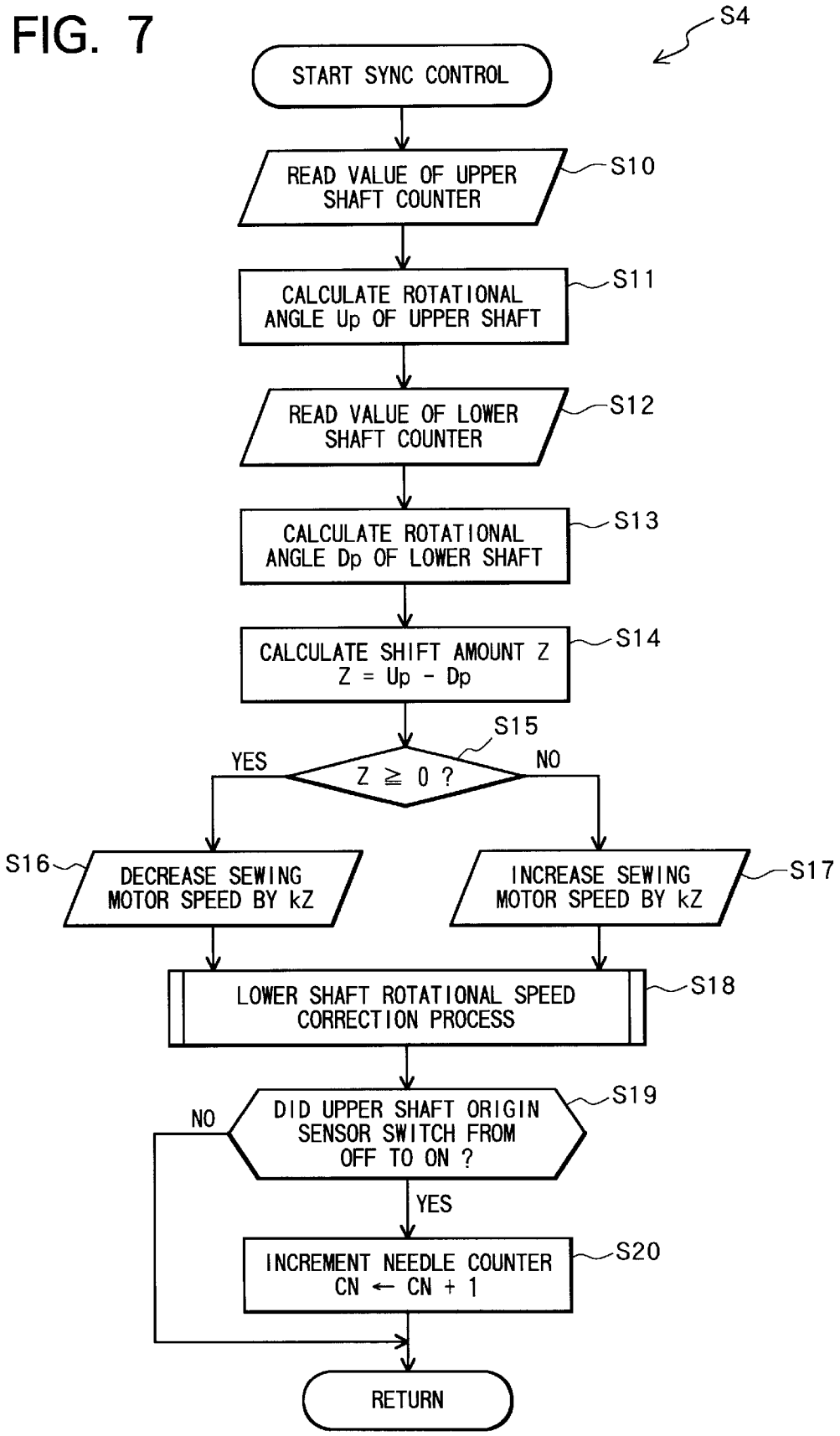
FIG. 7 is a flowchart showing a synchronization control subroutine.
Figure 8:
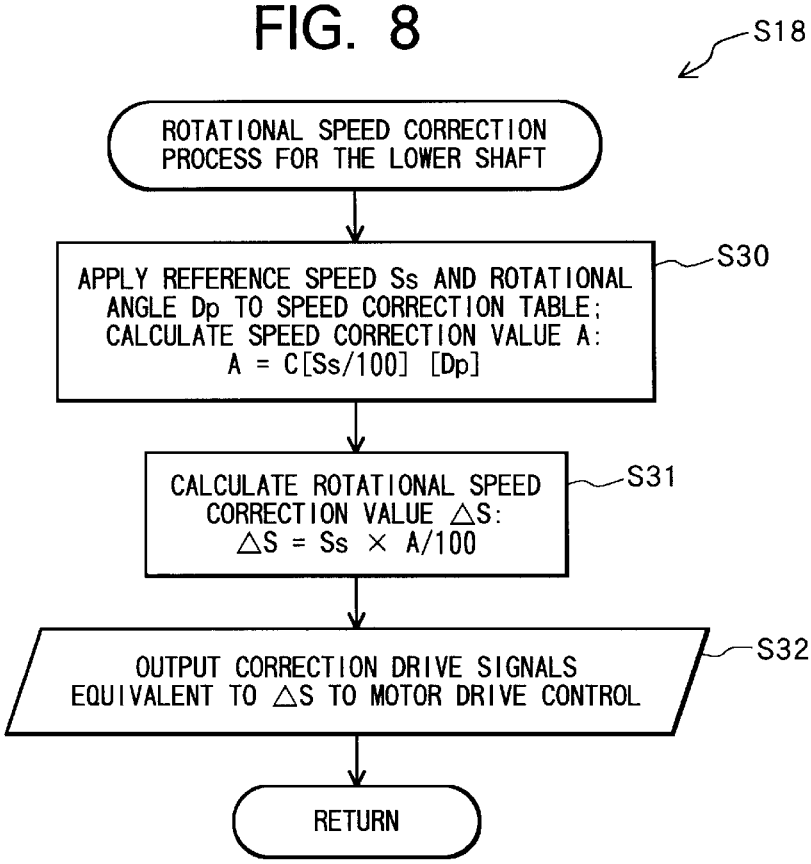
FIG. 8 is a flowchart showing a lower shaft rotational speed correction process subroutine.

According to the present modification, as the lower shaft 12 rotates from 0° to 360°, rotational speeds of the lower shaft 12 are calculated based on data of a plurality of rotational angles Dp of the lower shaft 12, which has been calculated and stored in the RAM 23 in S13 of FIG. 7. The calculated rotational speeds are stored in the RAM 23. Based on the thus calculated and stored rotational speeds, variations of the rotational speed in the lower shaft 12 are determined after every complete rotation of the lower shaft 12. These speed variations are then approximated by sine waves Wu and Wd as shown in FIG. 9. Based on the thus determined sine waves Wu and Wd, each of the parameter values A1, T1, θs1, A2, T2, and θs2 set in the parameter table 50 is changed by a single step amount. Based on the thus changed parameter values, a plurality of rotational speed correction amounts are calculated as indicative of correction sine waves indicated by the currently-changed parameter values. Based on the plurality of rotational speed correction amounts, the rotational speed of the lower shaft 12 is corrected in order to eliminate the speed variations represented by the currently-detected sine waves Wu and Wd. While the parameters A1, T1, θs1, A2, T2, and θs2 are repeatedly changed step by step through the above-described learning control operation, corresponding rotational speed correction values are repeatedly determined, and the rotational speed of the lower shaft 12 is repeatedly corrected accordingly.

The lower shaft rotational speed correction process of S18 according to the present modification will be described below with reference to the flowchart in FIG. 11.

First, in S40, the current rotational speed of the lower shaft 12 is determined through calculating differentials of a plurality of rotational angles Dp which have been already determined and stored in S13. More specifically, the current speed is determined through calculating a difference between the rotational angle Dp detected at S13 in the present routine and the rotational angle Dp detected at S13 in the latest routine. The thus calculated rotational speed value is stored in the RAM 23. Next, in S41, data of a rotational speed correction amount is read from the RAM 23 in correspondence with the current rotational angle Dp of the lower shaft 12. It is noted that the rotational speed correction amount has been calculated and stored in the RAM 23 during the interrupt routine (parameter change/correction amount calculation process routine) of FIG. 12 as will be described later.

Next, in S42, correction drive signals or correction data indicative of the rotational speed correction amount are output to the motor drive control. In response to the correction data, according to the motor drive control, the CPU 21 supplies the drive circuit 28 with a drive signal or speed command in the same manner as in S32 of FIG. 8. Then, the process returns to S19 in FIG. 7.

Next, the parameter change/correction amount calculation process will be described with reference to FIG. 12.

This routine is executed by an interrupt process every time the detection signals issued from the upper shaft origin sensor 17 switch from OFF to ON, in other words, when the needle reaches the uppermost position.

At the beginning of the process, in S50, the CPU 21 reads, from the RAM 23, data of a plurality of rotational speed values which the lower shaft 12 have attained during a current rotation. The current rotation has just been completed. The rotational speed value data has been calculated and stored in S40 of FIG. 11. Then, in S51, speed variation waveforms, which have been occurred during the current rotation when the rotational angle θ of the lower shaft 12 has been about 0° and 180°, are approximated by sine waves Wu and Wd as shown in FIG. 9. Parameters a, θ1, and θ2 defining each of the sine waves Wu and Wd are calculated and stored in the RAM 23 in S52.

In S53, the speed variation amount occurred around θ=0° during the current rotation is compared to the speed variation amount occurred around θ=0° during the latest rotation which has been performed immediately prior to the current rotation. It is noted that the parameters a, θ1, and θ2 of the sine wave Wu obtained during the latest rotation have already been stored in the RAM 23 in S52 which is performed during the latest-performed interruption of the present routine of FIG. 12. Accordingly, in S53, the value "a" of the sine wave Wu obtained during the current rotation is compared to the value "a" of another sine wave Wu obtained during the latest rotation. If the speed variation amount of the current rotation has not become smaller than that of the latest rotation (no" in S53), i.e., if the value "a" of the current rotation sine wave Wu is equal to or larger than that of the latest rotation sine wave Wu, then each of the values θs1, A1, and T1 in the parameter table 50 is changed by a single step amount to be updated in S54. On the other hand, when the current speed variation has become smaller than that of the latest speed variation ("yes" in S53), i.e., when the value a of the sine wave Wu detected at the current rotation is smaller than that detected during the latest rotation, then S54 is skipped.

It is noted that when initially setting the parameters in the parameter table 50, θs1 is set to a small value. Accordingly, when making the above-described step-by-step adjustment, θs1 is increased 10% each step, for example. A1 is increased or decreased to approach the parameter a of the sine wave Wu, and T1 is increased or decreased to approach the parameter of 2×(θ2−θ1), where θ2 and θ1 are parameters of the sine wave Wu.

It is noted, however, that it is possible to initially set the value θs1 to an estimated appropriate value, and change the value in steps so that the starting position of the correction sine wave around θ=0° is close to the starting position of the sine wave Wu even from an initial stage of the sewing operation.

Next, it is determined in S55 whether the currently-detected speed variation around θ=180° has become smaller than that in the previous rotation. It is noted that the parameters a, θ1, and θ2 of the sine wave Wd, obtained during the latest rotation, have already been stored in the RAM 23 in S52 which is performed during the latest-performed interruption of the present routine of FIG. 12. Accordingly, in S55, the value "a" of the sine wave Wd obtained during the current rotation is compared to the value "a" of another sine wave Wu obtained during the latest rotation. If the amount "a" of the current speed variation is determined not to be smaller than that in the previous rotation ("no" in S55), then each of the parameters θs2, A2, and T2 is changed by a step amount so as to be updated in S56. On the other hand, when the current speed variation has become smaller than that of the previous rotation ("yes" in S55), then S56 is skipped.

Since θs2 in the parameter table 50 has been initially set to a small value, θs2 is increased 10% each step, for example, through the above-described step-by-step adjustment operation. A2 is increased or decreased to approach the parameter a of the sine wave Wd, and T2 is increased or decreased to approach the amount of 2×(θ2−θ1), where θ2 and θ1 are parameters of the sine wave Wd. It is noted, however, that it is possible to initially set the amount θs2 to an estimated appropriate value, and change the value in steps so that the starting position of the correction sine wave around θ=180° is close to the starting position of the sine wave Wd even at the initial stage.

Next, in S57, a plurality of rotational speed correction amounts C(θ) are calculated for the next rotation using the parameters θs1, A1, and T1, and θs2, A2, and T2 presently updated in the parameter table 50. The plurality of rotational speed correction amounts C(θ) are calculated for a plurality of rotational positions θ of the lower shaft 12 from 0° to 360°. More specifically, 360 sets of data of rotational speed correction amounts are calculated for 360 different rotational positions from 0° to 360°. That is, for the rotational positions around 0°, the rotational speed correction amounts are calculated based on the values θs1, A1, and T1 now obtained in S54. For the rotational positions around 180°, the rotational speed correction amounts are calculated based on the values θs2, A2, and T2 now obtained in S56. For other remaining rotational positions, correction amounts of zero (θ) are set. It is noted, however, that if some variations occur at those rotational positions away from 0° and 180°, these variations can be approximated by sine waves, and correction amounts can be set in the same manner as described above. Data of the thus calculated plurality of rotational speed correction amounts are stored in the RAM 23 in S57. It is noted that the total number of the rotational speed correction amounts as calculated in S57 is equal to that of the rotational speed values read in S50. The thus calculated plurality of rotational speed correction amounts will be used in S41 during the next rotation and will develop the two correction sine waves as shown in FIG. 9.

That is, in S41 during the next rotation of the lower shaft 12, the rotational speed correction amounts C(θ) where 0°≧θ≦360° in the RAM 23 are searched referring to the current rotational position Dp of the lower shaft 12. Then, a speed correction amount C(θ) for the current rotational position θ=Dp is selected. It is noted that interpolation technique can also be used in the same manner as in S30 of FIG. 8. Then, in S42, a correction drive signal, indicative of this rotational speed correction amount C(θ), is output to the motor drive control. In response to the correction drive signal, according to the motor drive control program, the CPU 21 supplies the loop taker drive motor 14 with drive signals whose amounts are corrected by the correction amount C(θ). That is, the CPU 21 changes the speed command dSd (=Ss−Sd) into a variation-corrected speed command cSd (=dSd+C(θ)) . The CPU 21 then issues the variation-corrected speed command cSd (=dSd+C(θ)) to the drive circuit 28. The process then returns to S19.

As the above-described lower shaft rotational speed correction process of S18 and the parameter change/correction value calculation interrupt process of FIG. 12 are repeatedly executed, the parameters θs1, A1, and T1, and θs2, A2, and T2 in the parameter table 50 are successively updated according to the above-described learning control operation.

Each of the parameter values θs1, A1, and T1 converges to a certain value (characteristic value) which is indicative of a characteristic correction sine wave capable of neutralizing rotational speed variation of the lower shaft 12 around 0°. In other words, each of the parameter values θs1, A1, and T1 gradually approaches to the certain characteristic value capable of eliminating the lower shaft speed deviation around the 0-degree position. Similarly, each of the parameter values θs2, A2, and T2 converges to a certain value (characteristic value) which is indicative of a characteristic correction sine wave capable of neutralizing rotational speed variation of the lower shaft 12 around 180°. In other words, each of the parameter values θs2, A2, and T2 gradually approaches to the certain characteristic value capable of eliminating the lower shaft speed deviation around the 180-degree position.

By initially setting appropriate values for the parameters θs1, A1, and T1, and θs2, A2, and T2, those parameters will converge to their characteristic values within a comparatively short time through the learning control operation. Accordingly, rotational speed variations in the lower shaft 12, caused by torque variations of the loop taker 11, can be eliminated in that short time after the start of sewing operations, improving the precision of synchronization control and, therefore, improving the sewing quality. Moreover, only the parameters θs1, A1, T1, θs2, A2, and T2 can be previously set to appropriate initial values, decreasing the amount of data necessary for preparations.

Figure 13:
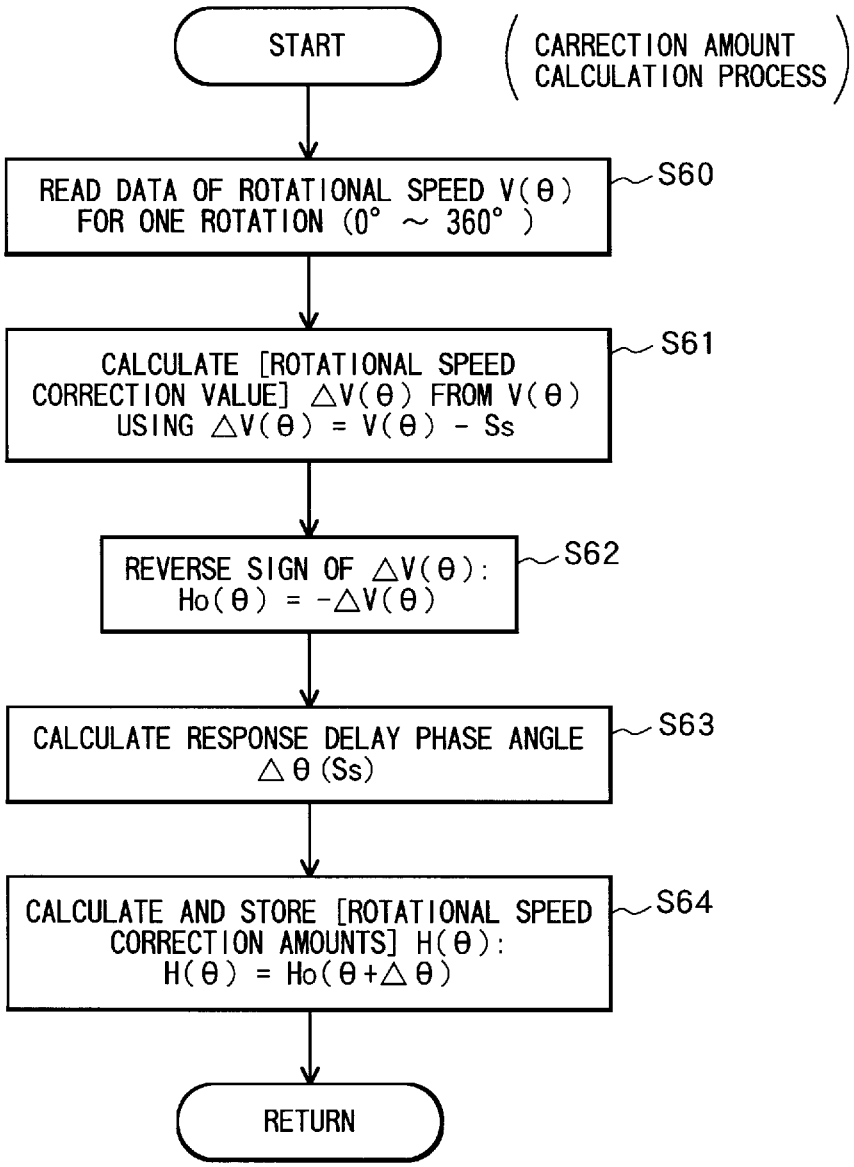
FIG. 13 is a flowchart showing a correction amount calculation process according to another modification.

The interrupt routine of FIG. 12 can be modified into a correction amount calculation process shown in FIG. 13. That is, the interrupt routine of FIG. 13 may be repeatedly attained while the processes of FIGS. 6 and 7 are performed with the subroutine S18 being attained as shown in FIG. 11.

This correction amount calculation process of FIG. 13 is designed to determine the rotational speed variation values during a current rotation of the lower shaft 12 from 0° to 360° and to reverse the sign of those values. The process then adjusts the rotational speed variation values considering the amount of response delay to determine rotational speed correction amounts over 0° to 360° for the next rotation.

The correction value calculation process routine, shown in the flowchart of FIG. 13, is executed by an interrupt process every time the detection signals from the upper shaft origin sensor 17 switch from OFF to ON, in other words, when the needle reaches the uppermost position.

At the beginning of the process, in S60, the CPU 21 reads, from the RAM 23, data of a plurality of rotational speeds V(θ) of the lower shaft 12 for the current rotation which has been just completed. Here, θ is the rotational angle, or phase angle, of the lower shaft 12, and the rotational speed V(θ) denotes a function of this phase angle θ. It is noted that data of the rotational speed V(θ) has been calculated and stored in S40 of FIG. 11.

Then, in S61, a rotational speed variation value ΔV(θ) is calculated using an equation $\Delta V(\theta)=V(\theta)-S_s$, where $S_s$ is the reference speed. Then, in S62, the sine of the value ΔV(θ) is reversed to obtain a value Ho(θ) through calculating an expression $Ho(\theta)=-\Delta V(\theta)$. A response time delay τ is defined as a time period after the motor 14 is supplied with drive signals until the rotational speed of the lower shaft 12 changes in response to the drive signals. The response time delay τ is approximately constant. It is noted, however, that the amount, that the lower shaft 12 rotates during the response delay time period τ, changes according to the reference speed $S_s$. Therefore, in S63, a response delay phase angle $\Delta\theta(S_s)$, that the lower shaft 12 will rotate during the response delay time period τ, is calculated based on a predetermined formula with using the reference speed $S_s$. That is, $\Delta\theta(S_s)=\tau\omega_s$ in which $\omega_s$ is an angular speed for the speed $S_s$. That is, $(\omega)_s=2\pi S_s/60$.

Next, in S64, a plurality of rotational speed correction amounts H(θ) for the next rotation from 0° to 360° are calculated using an expression $H(\theta)=Ho(\theta+\Delta\theta(S_s))$ considering the amount of the response delay phase angle $\Delta\theta(S_s)$. The calculated values are stored in the RAM 23. It is noted that the total number of the rotational speed correction amounts H(θ) is equal to or nearly equal to that of the data V(θ) read in S60. The correction amounts H(θ) will be read and used in S41 of FIG. 11 during the next rotation in the same manner as described already for the correction amounts C(θ) prepared in the process of FIG. 12.

According to the above-described correction amount calculation process, regardless of how rotational speed variations are generated in the lower shaft 12 at any rotation, these variations can be eliminated in the next rotation. This is because in the next rotation, the loop taker drive motor 14 is supplied with correction drive signals corresponding to the rotational speed correction amounts H(θ) which are calculated in the process of FIG. 13 as being capable of negating the variations. Especially, according to this modification, it is unnecessary to previously prepare any table stored with previously-calculated values. Further, the process of the present modification can be used both when the loop taker is constructed from an oscillating shuttle and when the loop taker is constructed from a rotary hook. The process of the present modification can eliminate any rotational speed variations occurring in the lower shaft 12 due to changes in any sewing conditions such as thickness of the workpiece to be sewn and a stitch pattern to be obtained.

It is noted that although omitted from the above description, when the sewing machine 1 is stopped, the upper shaft 8 and the lower shaft 12 can be brought into a nonsynchronous state when the user manually rotates the upper shaft 8 and/or the lower shaft 12. It is therefore desirable to initialize, immediately before the control process of FIG. 6, the upper shaft 8 to the uppermost needle position (0° rotational angular position) by controlling the sewing motor 10 and to initialize the lower shaft 12 to the 0° rotational angular position by controlling the loop taker drive motor 14.

As described above, according to the present invention, the sewing machine is provided with the independently driven main shaft and loop taker. The sewing machine is provided with the head portion equipped with the needle bar and the sewing needle which are driven by the sewing motor via the main shaft. The sewing machine is provided with the bed portion equipped with the loop taker, which operates in cooperation with the sewing needle to take a sewing thread loop. The sewing machine is further provided with the loop taker drive motor for driving the loop taker independently from the main shaft. The sewing machine is further provided with: the first detection unit for detecting both the origin position of the main shaft and the rotational angle of the sewing motor; the second detection unit for detecting both the origin position of the loop taker and the rotational angle of the loop taker drive motor; the synchronization control unit for controlling at least one of the sewing motor and the loop taker drive motor based on detection signals from the first and second detection units so that the loop taker rotates synchronously with the main shaft; and the correction unit for supplying the loop taker drive motor with correction drive signals for neutralizing rotational speed variations generated in the loop taker drive shaft due to torque variations transferred to the loop taker drive shaft from the loop taker.

The first detection unit can be configured as a single detection system for detecting both the origin of the main shaft and the rotational angle of the sewing motor or as two separate systems. Similarly, the second detection unit can be configured as a single detection system for detecting both the origin of the loop taker and the rotational angle of the loop taker drive motor or as two separate systems.

For example, each of the rotary encoder 10*a* and 14*a* can be designed so as to detect both the origin of the corresponding shaft and the rotational angle of the corresponding motor. Each of the rotary encoders 10*a* and 14*a* is constructed to issue three sets of signals comprised of: a phase A signal, a phase B signal, and a phase Z signal. The rotary encoder produces the phase Z signal pulse only once at its Z phase position. Accordingly, it is possible to determine the original position of the corresponding shaft based on the phase Z signal pulse if the rotary encoder is mounted so that its Z phase position is consistent with the original position of the corresponding shaft or is shifted from the shaft original position with a predetermined phase amount. Accordingly, when the rotary encoder is mounted to the motor as described above, the rotary encoder can detect both the origin of the shaft and the rotational angle of the motor.

The main shaft is at the origin position, for example, when the rotational angle (phase angle) of the sewing motor is at 0° and the needle is in the uppermost position. The loop taker is at the origin position, for example, when the rotational angle of the loop taker drive motor is at 0° and the needle is in the uppermost position.

The synchronization control unit controls at least one of the sewing motor and the loop taker drive motor so that the loop taker rotates synchronously with the main shaft. When the loop taker rotates synchronously with the main shaft, the loop taker reaches its origin position when the main shaft is at its own origin position. The looper seizing beak of the loop taker encounters the sewing needle at a predetermined angle of encounter when the main shaft and the loop taker drive shaft are positioned at the same encounter angle of 204.5°, for example. The loop-taker works in cooperation with the sewing needle to form a thread loop with a sewing thread arid performs sewing operation using the sewing thread and a bobbin thread. Thus, when the phase angle of the loop taker is equal to the angle of encounter when the phase angle of the main shaft is equal to the angle of encounter, synchronization between the main shaft and the loop taker is attained.

The speed correction unit outputs correction drive signals to the loop taker drive motor in order to neutralize rotational speed variations which occur in the loop taker drive shaft due to torque variations transferred from the loop taker. Hence, it is possible to alleviate or eliminate rotational speed variations of the loop taker drive shaft, thereby eliminating disparities in synchronization between the sewing motor and the loop taker. The correction drive signals can be produced using a previously-prepared correction value table. The correction drive signals can be produced through learning control, which analyzes detection signals indicative of rotational speed variations of the loop taker drive shaft.

The loop taker may be an oscillating shuttle, for example. When the oscillating shuttle reverses its rotating direction during its reciprocating rotational movement and when the shuttle takes a needle thread extending from the sewing needle, the shuttle drive system passes through mechanical points of discontinuity. As a result, torque of the shuttle drive system largely varies, and the rotational variation of the shuttle drive shaft becomes large. However, the rotational speed variations of the shuttle drive shaft can be neutralized by the speed correction unit.

The correction unit outputs correction drive signals for neutralizing the rotational speed variations. Hence, rotational speed variations of the loop taker drive shaft can be negated.

According to the modification, the correction unit outputs the plurality of correction drive signals which define a sine wave. When the behavior of the loop taker causes torque of the loop taker drive shaft to increase in an approximately pulse shape, rotational speed variations in the shape of a sine wave are generated by the servo system which is used to control driving of the loop taker drive motor. These rotational speed variations can be eliminated by the plurality of correction drive signals which form sine waves (correction sine waves) of a shape that is capable of negating the shape of the sine waves created by the rotational speed variations.

According to the modification, the correction unit automatically changes initial values for the amplitude, the period, and the starting point of the correction sine wave using learning control based on detection values of the rotational speed variations. Correction drive signals are automatically set based on the thus changed initial values. The initial values for the amplitude, the period, and the starting point of the correction sine wave are preset to appropriately-approximated values. During the sewing operation, those initial values are automatically adjusted according to the learning control so as to decrease the rotational speed variations. In so doing, it is possible to obtain correct values for the amplitude, the period, and the starting point of correction sine waves which can eliminate or nearly eliminate the rotational speed variations of the loop taker drive shaft. It is possible to automatically set correction drive signals based on the thus corrected values.

As described above, according to the present invention, the speed correction unit eliminates rotational speed variations occurring in the loop taker drive shaft due to torque variations which are transferred along the loop taker drive shaft. Accordingly, precision of the synchronization control for synchronizing the main shaft and the loop taker can be increased. Sewing quality can be improved, and damage to the sewing needle and the loop taker caused by disparities in synchronization can be eliminated.

Even when the loop taker is an oscillating shuttle, rotational speed variations in the shuttle drive shaft caused by torque variations occurring in the shuttle drive shaft can reliably be neutralized.

The speed correction unit issues correction drive signals for negating rotational speed variations in the shuttle drive shaft. Hence, such rotational speed variations can be negated.

The speed correction unit may output the plurality of correction drive signals defining a sine wave, which is effective in eliminating rotational speed variations which are caused by approximately pulse-shaped torque variations generated by the loop taker drive shaft. The sine wave correction signals are effective particularly when the loop taker is an oscillating shuttle.

When the speed correction unit automatically corrects initial values for the amplitude, the period, and the starting point of the sine wave based on detection values of the rotational speed variations, correction drive signals are automatically set based on the thus corrected initial values. Hence, it is possible to decrease the amount of data that must be previously input to set the correction drive signals. Correction drive signals can be automatically and economically determined in correspondence with the sewing conditions, such as the thickness of the workpiece cloth, types of stitch patterns, and sewing speeds.

While the invention has been described in detail with reference to the specific embodiment thereof, it would be apparent to those skilled in the art that various changes and modifications may be made therein without departing from the spirit of the invention.

For example, in the above-described embodiment, the synchronization control process of S4 is performed to control the movement of the upper shaft 8 in accordance with the movement of the lower shaft 12. However, the synchronization control process of S4 may be performed to control the lower shaft 12 in accordance with the upper shaft 8. According to the present invention, speed variations occurred in one of the two shafts 8 and 12 can be corrected in the correction process of S18, and synchronization between the two shafts can be attained in the process of S4.

What is claimed is:

1. A sewing machine, comprising:

a sewing motor for driving a needle bar and a sewing needle via a main shaft;

a loop taker drive motor for driving a loop taker via a loop taker drive shaft independently from the main shaft thereby causing the loop taker to operate in cooperation with the sewing needle to take a sewing thread loop;

a first detection unit for detecting both an origin position of the main shaft and a rotational angle of the sewing motor and for outputting detection signals indicative of the detected results;

a second detection unit for detecting both an origin position of the loop taker and a rotational angle of the loop taker drive motor and for outputting detection signals indicative of the detected results;

a synchronization control unit for controlling at least one of the sewing motor and the loop taker drive motor based on the detection signals supplied from the first and second detection units, thereby causing the loop taker to rotate synchronously to the main shaft; and a speed correcting unit for correcting a rotational speed of the loop taker drive motor to eliminate rotational speed variations generated in the loop taker drive shaft.

2. A sewing machine as claimed in claim 1, wherein the speed correcting unit corrects the rotational speed of the loop taker drive motor based on a detection signal indicative of the rotational angle of the loop taker drive motor which is supplied from the second detection unit.

3. A sewing machine as claimed in claim 2, wherein the speed correcting unit includes:

a correction amount obtaining unit for obtaining a correction amount based on the detection signal indicative of the rotational angle of the loop taker drive motor which is supplied from the second detection unit, the correction amount being capable of correcting the rotational speed of the loop taker drive motor to eliminate the rotational speed variations generated in the loop taker drive shaft; and a correction drive signal producing unit for producing a correction drive signal based on the obtained correction amount and for correcting the rotational speed of the loop taker drive motor based on the correction drive signal.

4. A sewing machine as claimed in claim 3, wherein the correction amount obtaining unit includes:

a storage unit for previously storing data of a plurality of speed correction values in correspondence with a plurality of rotational angles of the loop taker drive motor; and a selection unit for selecting data of a speed correction value based on the detection signal, indicative of the actual rotational angle of the loop taker drive motor, which is supplied from the second detection unit.

5. A sewing machine as claimed in claim 3, wherein the second detection unit repeatedly detects the rotational angle of the loop taker drive motor and successively outputs the detection signals indicative of the detected rotational angles, and wherein the correction amount obtaining unit includes a learning control unit for analyzing the detection signals successively outputted from the second detection unit as indicative of the detected rotational angles of the loop taker drive motor and for repeatedly calculating the correction amounts as capable of correcting the rotational speed of the loop taker drive motor to eliminate the rotational speed variations generated in the loop taker drive shaft.

6. A sewing machine as claimed in claim 5, wherein the learning control unit includes:

a rotational speed variation determining unit for repeatedly determining a rotational speed variation presently occurring in the loop taker drive shaft; and a correction amount determining unit for repeatedly determining a correction amount capable of eliminating the presently-occurring rotational speed variation.

7. A sewing machine as claimed in claim 6, wherein the rotational speed variation determining unit includes an estimating unit for estimating the determined rotational speed variation in the form of a sine wave, the correction amount determining unit determines data of a plurality of correction amounts representative of a sine wave which is capable of neutralizing the estimated sine wave-shaped rotational speed variation.

8. A sewing machine as claimed in claim 7, wherein the correction amount determining unit includes:

a sine wave data storage unit for storing sine wave data indicative of a sine wave;

a sine wave data correcting unit for correcting the sine wave data stored in the sine wave data storage unit based on the estimated sine wave-shaped rotational speed variation; and a correction amount calculating unit for calculating the plurality of correction amounts based on the corrected sine wave data.

9. A sewing machine as claimed in claim 8, wherein the sine wave data includes data of an amplitude, a period, and a starting point of the sine wave.

10. A sewing machine as claimed in claim 1, wherein the first detection unit includes:

a main shaft origin detection sensor provided to the main shaft; and a rotary encoder provided to the sewing motor, and wherein the second detection unit includes:

a loop taker origin detection sensor provided to the loop taker drive shaft; and another rotary encoder provided to the loop taker drive motor.

11. A sewing machine as claimed in claim 1, wherein the loop taker is an oscillating shuttle.

12. A sewing machine as claimed in claim 3, wherein the correction amount obtaining unit produces a correction amount capable of neutralizing the rotational speed variations.

13. A sewing machine as claimed in claim 2, wherein the speed correcting unit produces a correction drive signal for correcting the rotational speed of the loop taker drive motor so as to eliminate the rotational speed variations generated in the loop taker drive shaft.

14. A sewing machine as claimed in claim 13, wherein the loop taker is an oscillating shuttle.

15. A sewing machine as claimed in claim 13, wherein the speed correcting unit produces a correction drive signal for neutralizing the rotational speed variations.

16. A sewing machine as claimed in claim 15, wherein the speed correcting unit produces a plurality of sets of correction drive signals in the form of a sine wave to neutralize the rotational speed variations.

17. A sewing machine as claimed in claim 13, further comprising a command input unit for inputting a command for driving the sewing motor and the loop taker drive motor to perform a sewing operation, wherein the first detection unit repeatedly detects the origin position of the main shaft and the rotational angle of the sewing motor while the sewing motor is driven, to thereby repeatedly output detection signals indicative of the detected results, and wherein the second detection unit repeatedly detects both the origin position of the loop taker and the rotational angle of the loop taker drive motor while the loop taker drive motor is driven, to thereby repeatedly output detection signals indicative of the detected results.

18. A sewing machine as claimed in claim 17, wherein the speed correcting unit includes:

a storage unit for previously storing data of a plurality of speed correction values; and a selection unit for repeatedly selecting data of a speed correction value based on the detection signals indicative of the rotational angle of the loop taker drive motor and for producing the correction drive signal based on the selected speed correction value.

19. A sewing machine as claimed in claim 17, wherein the speed correcting unit includes a learning control unit for repeatedly analyzing the detection signals indicative of the rotational angle of the loop taker drive motor and for repeatedly calculating the correction drive signal.

20. A sewing machine as claimed in claim 19, wherein the learning control unit includes:

an initial value storage unit for previously storing data of initial values for an amplitude, a period, and a starting point of a sine wave for correcting the rotational speed variations;

an automatic correction unit for automatically correcting the stored data of the initial values for the amplitude, the period, and the starting point of the sine wave based on the detection signals indicative of the rotational angle of the loop taker drive motor; and a correction drive signal setting unit for setting the correction drive signal in the form of a sine wave based on the automatically-corrected data.

* * * * *